US008899440B2

(12) United States Patent
Arnold et al.

(10) Patent No.: US 8,899,440 B2
(45) Date of Patent: Dec. 2, 2014

(54) MUG AND AMBIDEXTROUS LID ASSEMBLY

(75) Inventors: Kent M. Arnold, Cincinnati, OH (US); Troy Cooksey, Cincinnati, OH (US)

(73) Assignee: Broodle Brands, LLC, Cincinnati, OH (US)

( * ) Notice: Subject to any disclaimer, the term of this patent is extended or adjusted under 35 U.S.C. 154(b) by 49 days.

(21) Appl. No.: 13/369,926

(22) Filed: Feb. 9, 2012

(65) Prior Publication Data

US 2013/0206764 A1 Aug. 15, 2013

(51) Int. Cl.

| | |
|---|---|
| ***A47G 19/22*** | (2006.01) |
| ***B65D 45/26*** | (2006.01) |
| ***B65D 43/18*** | (2006.01) |

(52) U.S. Cl.

USPC ..... 220/715; 220/254.4; 220/253; 220/262; 222/557

(58) Field of Classification Search

USPC ..... 220/714, 715, 254.4, 262, 281, 592.16, 220/592.17, 253, 729, 737; 222/517, 557

See application file for complete search history.

(56) References Cited

U.S. PATENT DOCUMENTS

| | | | | |
|---|---|---|---|---|
| 2,154,346 | A | 4/1939 | Mills | |
| 2,187,927 | A | 1/1940 | Ayotte | |
| 3,556,341 | A | 1/1971 | Rains | |
| 3,642,122 | A | 2/1972 | Von Ende | |
| 3,847,311 | A | 11/1974 | Flores et al. | |
| 3,964,631 | A | 6/1976 | Albert | |
| 3,972,443 | A | 8/1976 | Albert | |
| 4,040,549 | A * | 8/1977 | Sadler | 224/483 |
| 4,276,992 | A | 7/1981 | Susich | |
| 4,303,173 | A | 12/1981 | Nergard | |
| 4,561,563 | A | 12/1985 | Woods | |
| 4,615,463 | A | 10/1986 | Price et al. | |
| 4,974,741 | A * | 12/1990 | Gustafson et al. | 220/739 |
| 5,036,993 | A | 8/1991 | Ramsey | |
| 5,148,936 | A | 9/1992 | DeGrow | |
| 5,169,016 | A | 12/1992 | Hinz, Jr. | |
| 5,186,350 | A * | 2/1993 | McBride | 220/739 |
| 5,222,623 | A | 6/1993 | Eger et al. | |
| 5,249,703 | A | 10/1993 | Karp | |
| 5,294,014 | A | 3/1994 | Wyatt et al. | |
| 5,307,950 | A | 5/1994 | Li | |
| 5,465,891 | A | 11/1995 | Bridges | |
| 5,477,980 | A | 12/1995 | Chaffin | |
| 5,653,124 | A | 8/1997 | Weber | |

(Continued)

OTHER PUBLICATIONS

PCT Search Report and Written Opinion for Corresponding PCT Application No. PCT/US2011/050814; mailed Jun. 29, 2012 (8 pages).

(Continued)

*Primary Examiner* — Fenn Mathew
*Assistant Examiner* — James N Smalley
(74) *Attorney, Agent, or Firm* — W. Charles Ehlers; Daniel F. Nesbitt; Hasse & Nesbitt LLC

(57) ABSTRACT

A beverage lid comprising a lid body having an aperture for dispensing a beverage. The beverage lid has a top portion having an aperture for dispensing a beverage mounted to the lid body, a slideable arm having a first end and a second end opposite the first end, the slideable arm mounted between the lid body and the top portion, a rotatable plate having at least one aperture for dispensing a beverage mounted between the body and the top portion, and a rotatable plate actuating mechanism communicating the slideable arm with the rotatable plate.

18 Claims, 16 Drawing Sheets

(56) References Cited

U.S. PATENT DOCUMENTS

| | | | | |
|---|---|---|---|---|
| 5,839,596 | A | 11/1998 | Zahn et al. | |
| 5,918,761 | A | 7/1999 | Wissinger | |
| 5,921,425 | A * | 7/1999 | Markey | 220/254.4 |
| 6,098,834 | A | 8/2000 | Hatsumoto et al. | |
| 6,155,452 | A | 12/2000 | Laurent | |
| 6,305,656 | B1 | 10/2001 | Wemyss | |
| 6,352,166 | B1 | 3/2002 | Copeland | |
| 6,557,717 | B1 * | 5/2003 | Keck | 220/254.9 |
| 6,626,326 | B2 | 9/2003 | Murakami | |
| 6,763,964 | B1 | 7/2004 | Hurlbut et al. | |
| 7,513,380 | B2 | 4/2009 | Canedo | |
| D686,883 | S | 7/2013 | Arnold et al. | |
| D688,092 | S | 8/2013 | Arnold et al. | |
| D688,094 | S | 8/2013 | Arnold et al. | |
| 2005/0006386 | A1 | 1/2005 | Ronn et al. | |
| 2006/0283859 | A1 | 12/2006 | Lu | |
| 2009/0057324 | A1 | 3/2009 | Wu | |
| 2010/0102059 | A1 * | 4/2010 | Ruse, Jr. | 220/254.5 |
| 2010/0108703 | A1 * | 5/2010 | French | 220/737 |

OTHER PUBLICATIONS

U.S. Appl. No. 13/227,914, filed Sep. 8, 2011, Kent et al.
U.S. Appl. No. 29/464,590, filed Aug. 19, 2013, Kent et al.
U.S. Appl. No. 29/412,993, filed Feb. 9, 2012, Kent et al.
U.S. Appl. No. 13/841,093, filed Mar. 15, 2013, Kent.
U.S. Appl. No. 29/450,011, filed Mar. 15, 2013, Kent.

* cited by examiner

MUG AND AMBIDEXTROUS LID ASSEMBLY

FIELD OF THE INVENTION

This invention relates generally to a mug and lid assembly. More particularly, this invention relates to a mug and lid assembly for ambidextrous usage with mechanisms for attaching the mug and lid assembly to a variety of bases.

BACKGROUND OF THE INVENTION

Mug and lid assemblies using valves are known. The assemblies are typically used for holding coffee or other beverages when traveling by vehicle or walking. The mug and lid assemblies are designed to seal a beverage dispensing aperture to prevent spillage when not in use. To drink from the assembly, one opens the valve mechanism and dispenses the beverage.

A mug and lid assembly that is ambidextrous, allowing operation of the valve mechanism with the left or right hand, is desired.

SUMMARY OF THE INVENTION

A beverage lid comprising a lid body having an aperture for dispensing a beverage, a top portion having an aperture for dispensing a beverage mounted to the lid body, a slideable arm having a first end and a second end opposite the first end, the slideable arm mounted between the lid body and the top portion, a rotatable plate having at least one aperture for dispensing a beverage mounted between the body and the top portion, and a rotatable plate actuating mechanism communicating the slideable arm with the rotatable plate.

An apparatus comprising a beverage holder support having an upper end, a lower end, and a sidewall disposed therebetween adapted to fit in a cup holder, a holder connector disposed on the upper end of the beverage holder support, a device having an upper end, a lower end, and a device connector disposed on the lower end of the device, and wherein the holder connector is sized to receive the device connector.

DETAILED DESCRIPTION OF THE INVENTION

Figure 1:
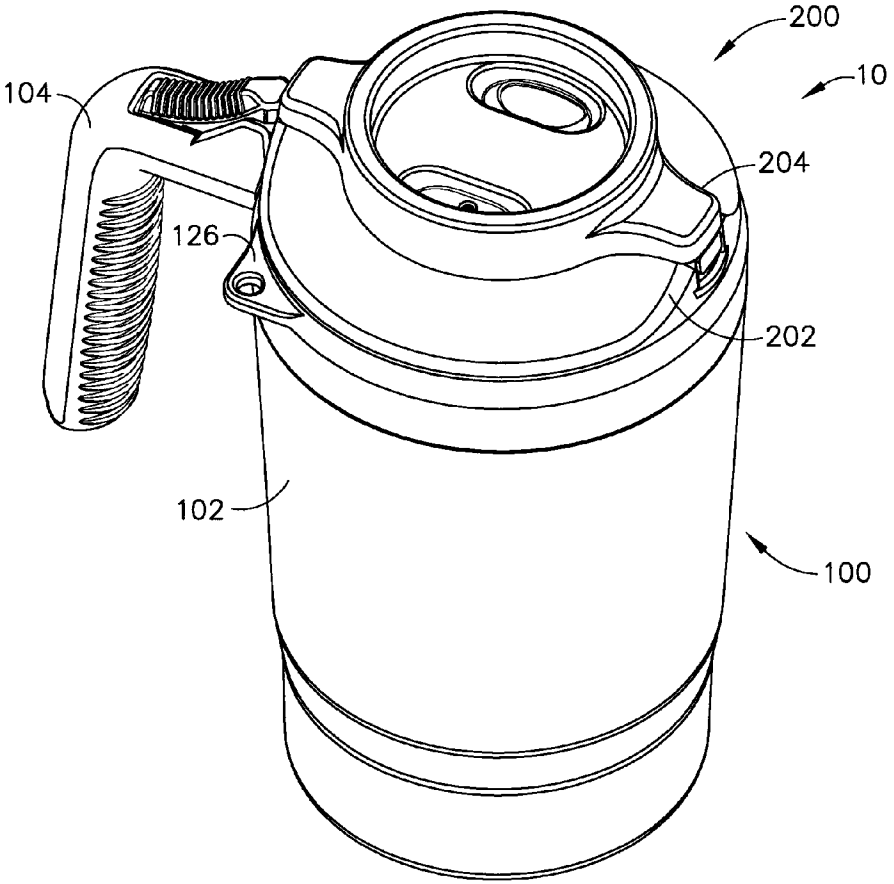
FIG. 1 is a perspective view of a mug and lid assembly of the invention.

FIG. 1 shows a mug and lid assembly 10 having a mug component 100 and a lid component 200. The mug component has an outer shell 102 and a handle 104. The lid component has a lid body 202 and a lid cap 204.

Figure 2:
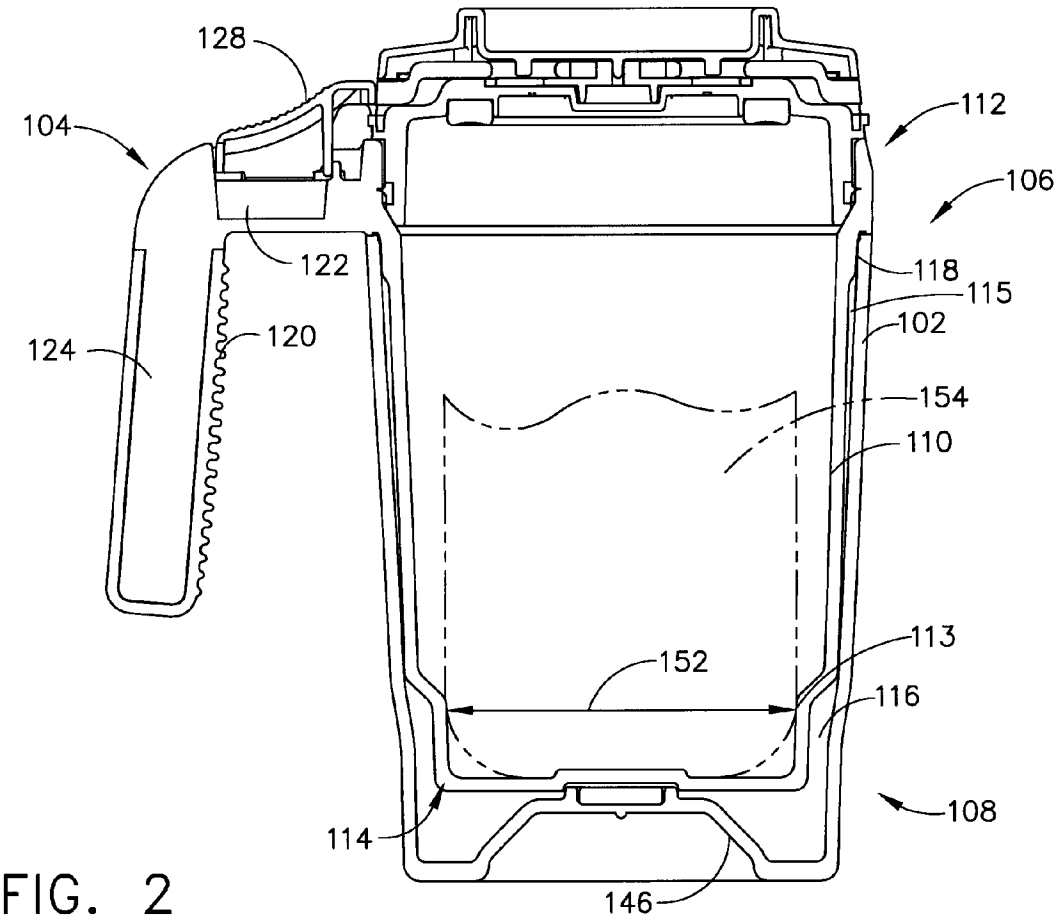
FIG. 2 is a section view of a mug component of the invention.

FIG. 2 shows a section view of the mug component 100. The outer shell 102 of the mug component 100 has an open upper end 106 and a closed lower end 108 and a cavity 115. Disposed within the cavity 115 of the outer shell 102 is an inner shell 110 having an open upper end 112 and a closed lower end 114. Between the outer shell 102 and the inner shell 110 is an insulating cavity 116. The insulating cavity 116 may be filled with air or other insulating material or it may contain a vacuum. Typically, the upper end of the outer shell 102 and the upper end of the inner shell 110 are joined together. They may be joined together at a joint 118 with an adhesive, snap lock, weldment, or any other type of attachment mechanism that will sufficiently join the upper end of the inner shell with the upper end of the outer shell. Either or both the inner and outer shells may be plastic, stainless steel, another material suitable for creating a mug component, or a combination thereof. If a vacuum or air is used as the insulating material between the inner shell and the outer shell, then the joint 118 should be airtight. A connector for receiving a chain, rope or other attachment device for attaching the mug to an article such as a backpack or clothing may also be included. The lower portion of the outer shell of the mug has a receiver 146 for receiving a connector of a beverage holder support, described later.

The mug also has a handle 104 with an attaching portion 122 and a holding portion 124. The handle may be an integral part of the inner shell, or of the outer shell, or it may be a separate part affixed to the inner shell or to the outer shell. The handle may also have a soft grip 120 for increased comfort. The grip may slide onto a holding portion 124 of the handle or it may be over-molded onto the holding portion 124 of the handle. The attaching portion 122 of the handle also has a slideable actuator 128 for actuating a lid mechanism, described later.

The lower end 114 of the inner shell 110 has a beverage can locating member 113 that defines an inside dimension 152 adapted to fit a beverage can 154. The can locating member 113 may be at the lower end 114, may be at or extend to midway between the lower end 114 and the upper end 112, may be at or extend to the upper end 112, or may be at or extend to a location between the lower end 114 and the upper end 112. As shown, the beverage can locating member 113 can be a cylindrical member that tapers from the inner shell 110. Instead of being cylindrical, the beverage can locating member could have ribs or vertical fins of a quantity and dimension necessary to hold the beverage can. Using ribs or vertical fins maximizes the beverage holding capacity of the mug when it is used without a beverage can. The ribs or vertical fins may be at the lower end 114, may be at or extend to midway between the lower end 114 and the upper end 112, may be at or extend to the upper end 112, or may be at or extend to a location between the lower end 114 and the upper end 112.

Figure 3:
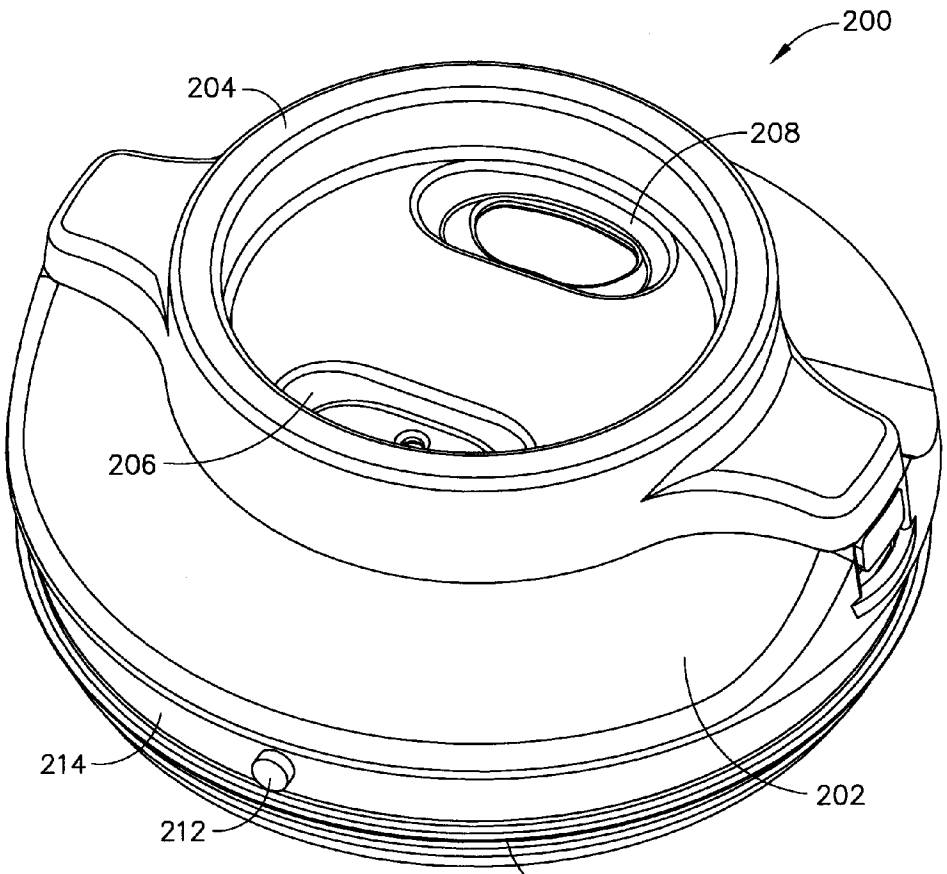
FIG. 3 is a perspective view of a lid component of the invention.
Figure 4A:
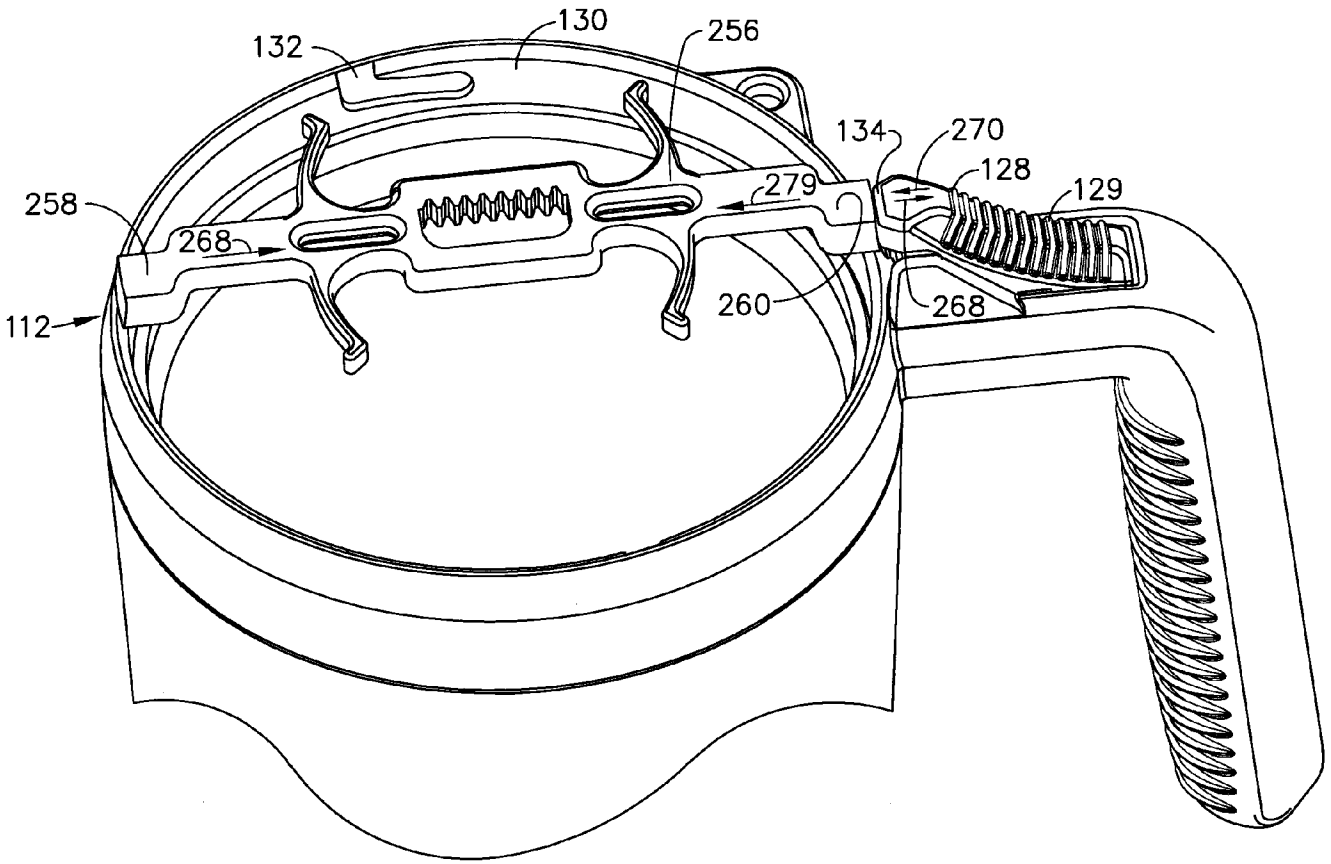
FIG. 4A is a perspective view of a mug component of the invention with a slideable arm of the invention.

FIG. 3 shows a perspective view of the lid component 200 with the lid body 202 and lid cap 204. The lid cap 204 has a first aperture 206 and a second aperture 208. Typically, one of the apertures is a vent and the other aperture is for dispensing a beverage. Here, the second aperture 208 is a beverage dispensing aperture. Disposed annularly around an outer circumference 214 of the lid body 202 is a seal 210. FIG. 4A shows an inside circumference 130 of the upper end 112 of the inner shell against which the seal 210 mates. The inside circumference 130 of the upper end 112 also has at least one L-shaped recess 132 for receiving a tab 212 located on the outer circumference 214 of the lid body, shown in FIG. 3. The L-shaped recess 132 and the tab 212 provide a means for locking the lid body to the mug.

Figure 5A:
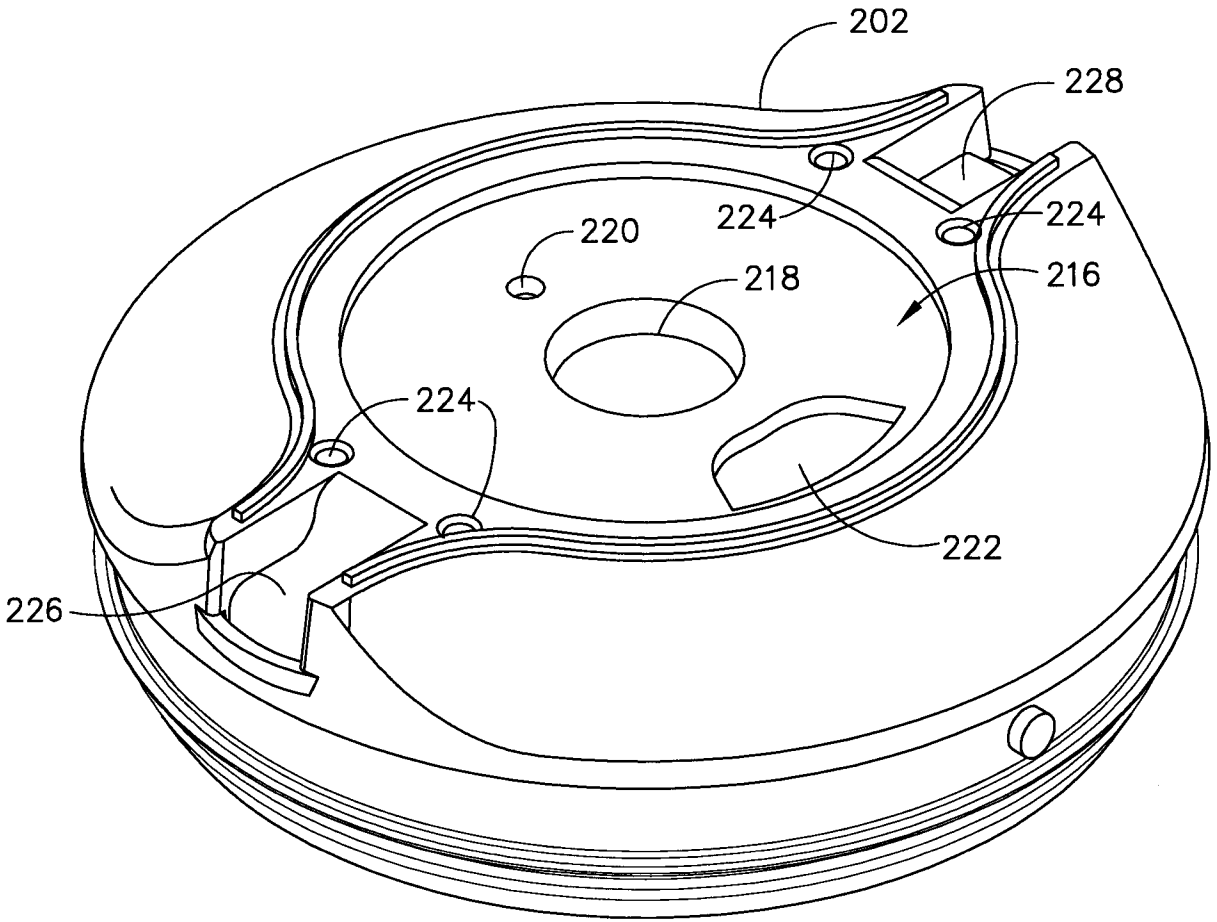
FIG. 5A is a perspective view of a lid body of the invention.

FIG. 5A shows a perspective view of the lid body 202 with the lid cap 204 removed. A top portion 216 of the lid body 202 has a central aperture 218, a vent hole 220, and a beverage dispensing aperture 222. The top portion also contains a plurality of receiving holes 224 for receiving prongs protruding from the lid cap, described later, and a first alignment cavity 226 located opposite a second alignment cavity 228.

Figure 5B:
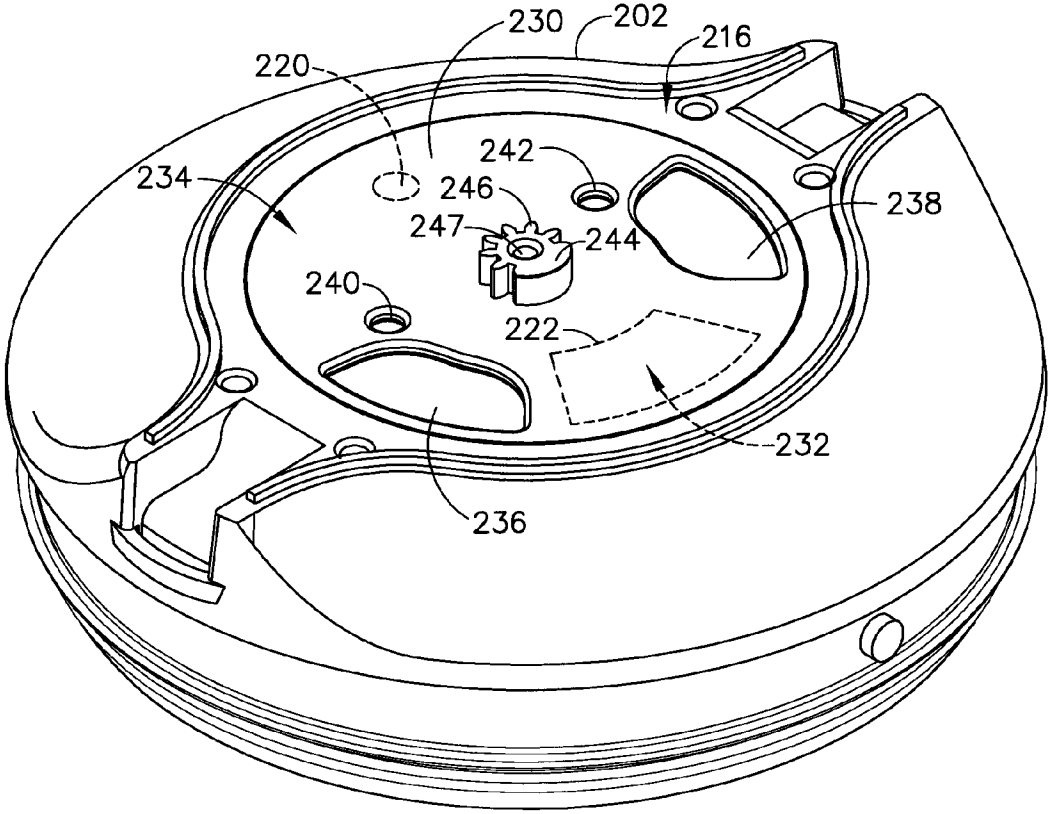
FIG. 5B is a perspective view of the lid body of FIG. 5A with a rotatable sealing plate installed.

FIG. 5B shows a perspective view of the lid body 202 with a rotatable sealing plate 230 set on the top portion 216 of the lid body 202. The rotatable sealing plate 230 in FIG. 5B is shown in the sealed position, with a first solid portion 232 covering the beverage dispensing aperture 222 in the lid body 202 and a second solid portion 234 covering the vent hole 220 in the lid body 202. The rotatable sealing plate 230 has a first beverage dispensing aperture 236, a second beverage dispensing aperture 238, a first vent hole 240, and a second vent hole 242. A gear 244 having teeth 246 and guide hole 247 is shown on the rotatable sealing plate 230.

Figure 5C:
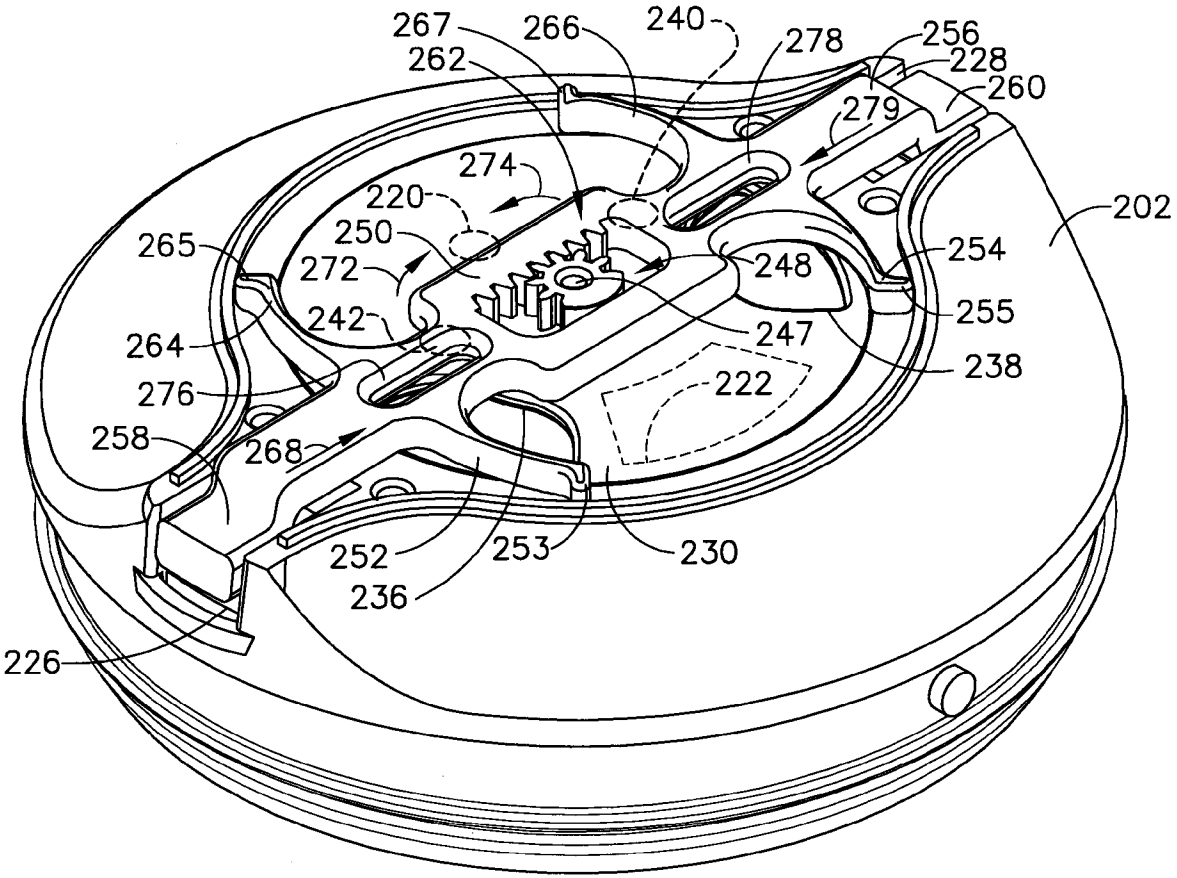
FIG. 5C is a perspective view of the lid body of FIG. 5A with the rotatable sealing plate and slideable arm installed.

FIG. 5C shows a perspective view of the lid body 202, rotatable sealing plate 230, and slideable arm 256. The slideable arm 256 has a first end 258 for engaging in a first alignment cavity 226 and a second end 260 for engaging in a second alignment cavity 228. A central portion 262 of the slideable arm 256 defines a cavity 248 for receiving the gear 244 and includes a rack 250 that meshes with the teeth 246 of the gear 244. The combination of the gear 244 and the rack 250 creates a rotatable plate actuating mechanism. Other drive mechanisms may also be used to create a rotatable plate actuating mechanism. The central portion 262 also defines a first travel limiting slot 276 and a second travel limiting slot 278. Alternatively, only one travel limiting slot may be used. Disposed between the central portion 262 and the first end 258 is a first spring 252, and disposed between the central portion 262 and the second end 260 is a second spring 254. Additional springs, such as spring 264 and spring 266, may also be utilized.

Figure 5D:
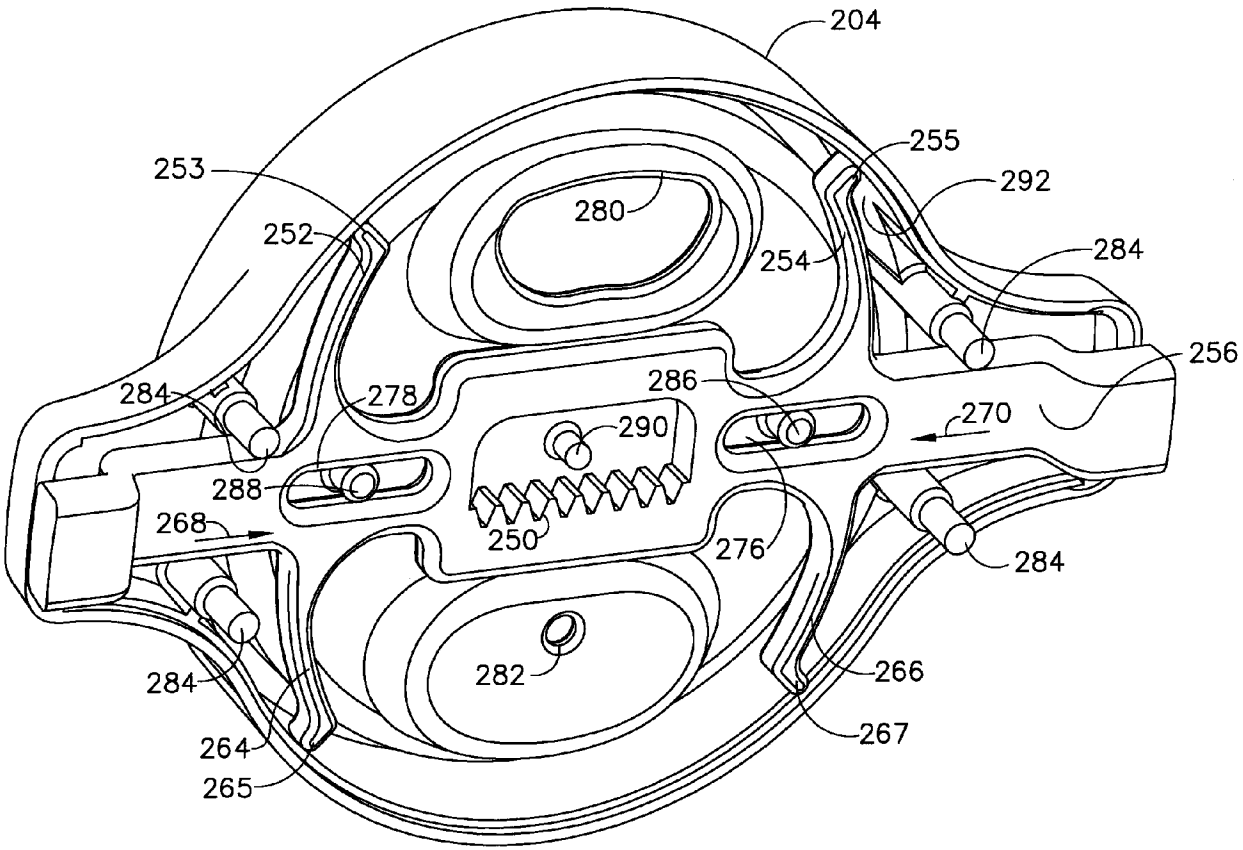
FIG. 5D is a perspective view of a lid cap of the invention with the slideable arm installed.

FIG. 5D depicts a bottom view of the lid cap 204 with the slideable arm 256. The lid cap has a beverage dispensing aperture 280 and a lid cap vent hole 282. Cap alignment posts 284 correspond to the receiving holes 224 in the lid body 202 (FIG. 5A) when the lid cap is installed onto the lid body. Here, four cap alignment posts 284 and four receiving holes 224 are used, but more or less may also be used. When the lid cap 204 is installed on the lid body 202, the lid cap beverage dispensing aperture 280 aligns with the lid body beverage dispensing aperture 222 and the lid cap vent hole 282 aligns with the lid body vent hole 220. Travel limiting post 286 is affixed to the underside of the lid cap and is received in the first travel limiting slot 276 of the slideable arm 256, and travel limiting post 288 is affixed to the underside of the lid cap and is received in the second travel limiting slot 278 of the slideable arm 256. A guide pin 290 is received by the guide hole 247 of the gear 244 to properly align and mesh the teeth 246 with the rack 250. The springs 252, 254, 264 and 266 have distal ends 253, 255, 265, and 267 bear against the inner circumference 292 of the lid cap 204 to maintain the center position of the slideable arm 256 as shown in FIG. 5D.

Figure 4B:
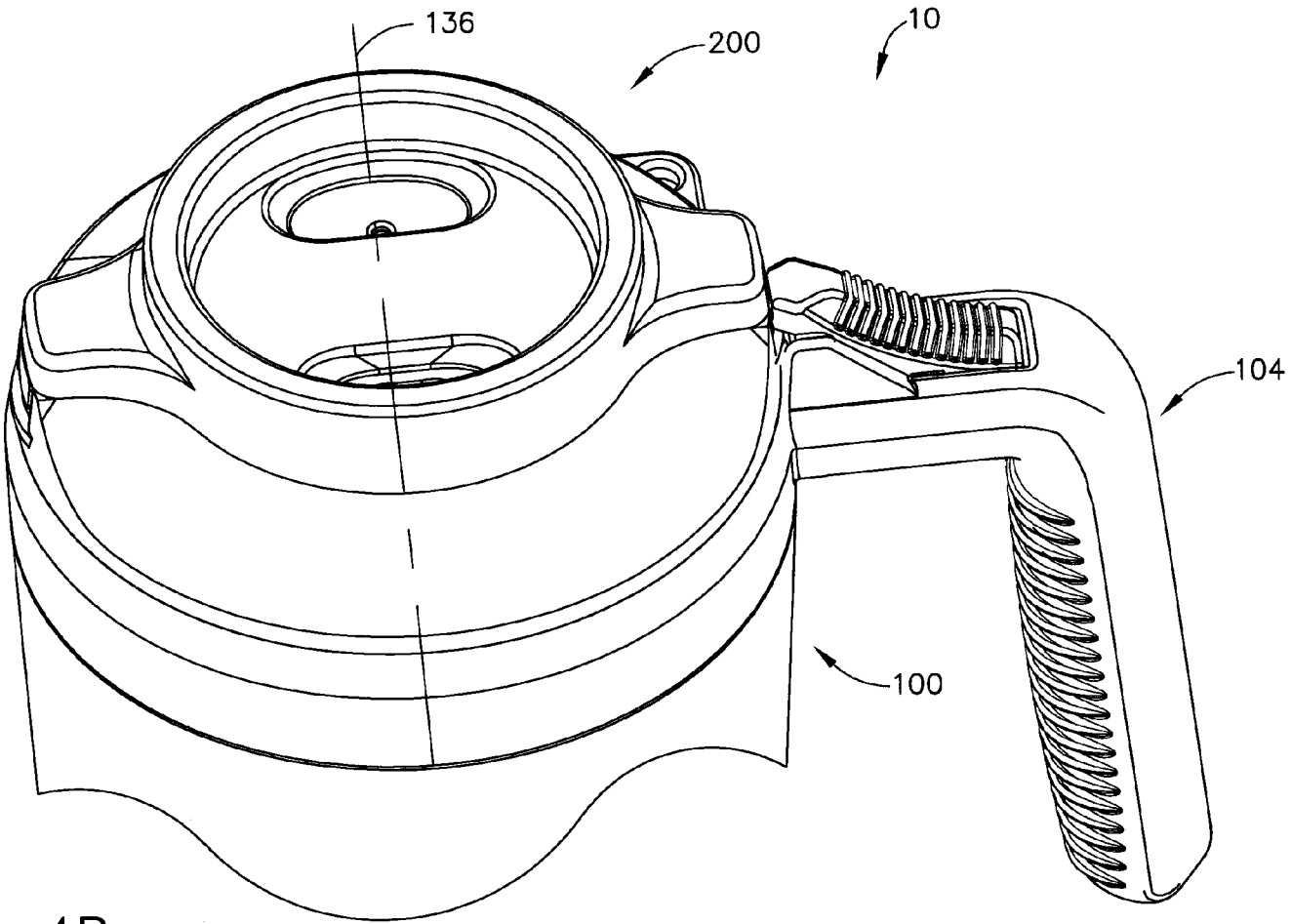
FIG. 4B is an enlarged perspective view of the mug and lid assembly of FIG. 1.

A forward end 134 of the slideable actuator 128 is shown abutting the second end 260 of the slideable arm in FIG. 4A. The slideable actuator 128 has a friction portion 129 for receiving a user's thumb. When the slideable actuator 128 is pushed in the direction of arrow 270, the forward end 134 pushes the slideable arm 256 in the same direction, shown by arrow 279. Because the lid component 200 and its parts are symmetrical about a transverse line 136, as shown in FIG. 4B, the lid may be rotated 180 degrees so that it may be operated with the handle on the left side or on the right side. When installed as shown in FIG. 4B, the mug and lid assembly 10 is for right hand use, where a user would hold the handle 104 in a right hand and use a right thumb to push the slideable actuator 128 in the direction of arrow 270 to dispense a beverage. When the lid component 200 is rotated 180 degrees, the user holds the mug in a left hand and uses a left thumb to push the slideable actuator 128 in the direction of arrow 270, causing the slideable arm 256 to move in the direction of arrow 268, to dispense a beverage.

FIG. 5C shows the rotatable sealing plate in the closed position. In right handed operation, when the slideable arm 256 is pushed in the direction of arrow 279, the rack 250 operating on the teeth 246 of the gear 244 rotates the rotatable sealing plate in the direction of arrow 274. Rotating the rotatable sealing plate in the direction of arrow 274 causes a first beverage dispensing aperture 236 in the rotatable sealing plate 230 to align with the beverage dispensing aperture 222 in the lid body 202 and with the beverage dispensing aperture 208 in the lid cap 204. Correspondently, the first vent hole 240 in the rotatable sealing plate aligns with the vent hole 220 in the lid body and with the first aperture 206 in the lid cap. At the same time, the springs 252 and 264, biased against the inner circumference 292 of the lid cap 204, are imparting a force on the slideable arm 256 in the direction of arrow 268 in an attempt to rotate the rotatable sealing plate 230 to the closed position. When a user releases the slideable actuator 128, the springs 252 and 264 push the slideable arm 256 in the direction of arrow 268 closing the beverage dispensing apertures. Instead of being biased against the inner circumference of the lid cup, the springs may be biased against the top portion of the lid body.

For left handed use, the lid component 200 is rotated 180 degrees so the first end 258 of the slideable arm 256 mates with the forward end 134 of the slideable actuator 128. In left handed operation, when the slideable arm 256 is pushed in the direction of arrow 268, the rack 250 operating on the teeth 246 of the gear 244 rotates the rotatable sealing plate in the direction of arrow 272. Rotating the rotatable sealing plate in the direction of arrow 272 causes a second beverage dispensing aperture 238 in the rotatable sealing plate 230 to align with the beverage dispensing aperture 222 in the lid body 202 and with the beverage dispensing aperture 208 in the lid cap 204. Correspondently, a second vent hole 242 in the rotatable sealing plate aligns with the vent hole 220 in the lid body and with the first aperture 206 in the lid cap. At the same time, the springs 254 and 266, biased against the inner circumference 292 of the lid cap 204, are imparting a force on the slideable arm 256 in the direction of arrow 270 to rotate the rotatable sealing plate 230 to the closed position. When a user releases the slideable actuator 128, the springs 254 and 266 push the slideable arm 256 in the direction of arrow 270 closing the beverage dispensing apertures.

Figure 6:
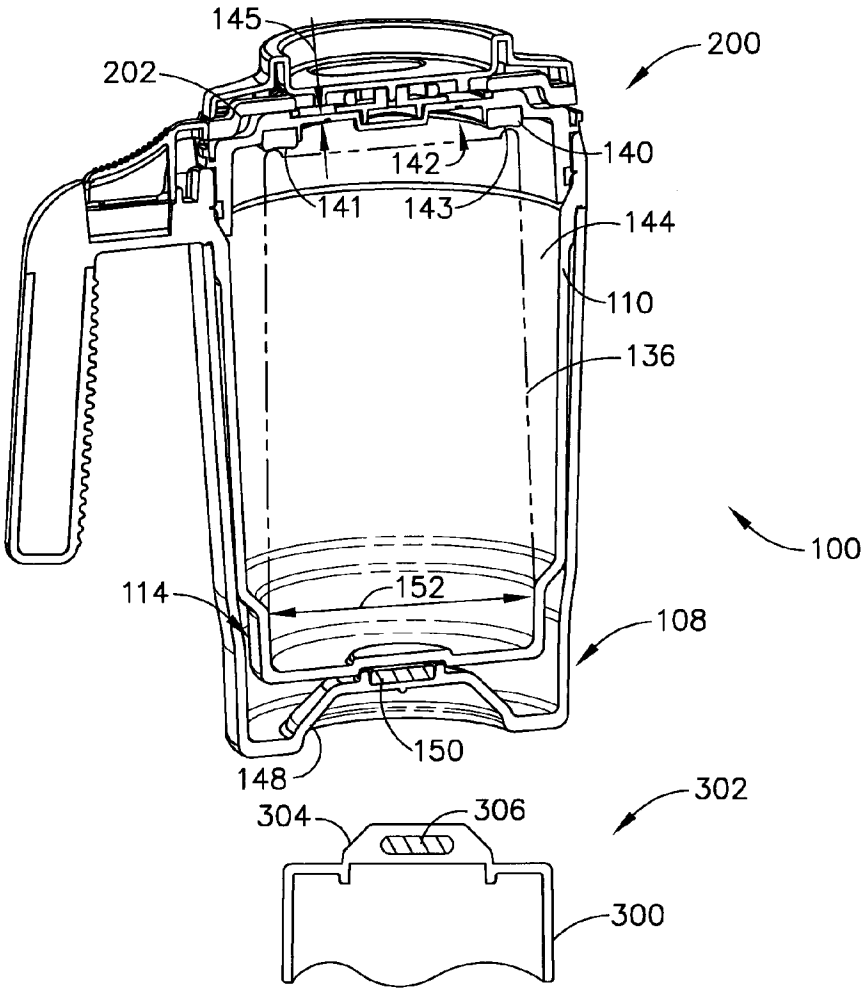
FIG. 6 is a section view of the mug and lid assembly of FIG. 1 with a beverage holder support of the invention.

FIG. 6 is a section view showing the mug component 100 with the lid component 200. Disposed in the inner shell 110 is shown a beverage can 136. The inside dimension 152 of lower end 114 of the inner shell 110 is sized to accommodate the beverage can. Disposed below the lid body 202 is an internal annular seal 140 having a sealing surface 143 for creating a sealed joint 141 to separate a void 142 between the beverage can 136 and the internal seal 140 from a void 144 between the beverage can 136 and the inner shell 110. The seal may be a disk, an o-ring, or any other shape capable of providing an adequate seal between void 142 and void 144. Typically, the internal seal 140 is made of rubber, but other types of soft compounds capable of providing an adequate seal between the void 142 and the void 144 may also be used.

Typically the seal is a detachable seal so that various size seals may be used to accommodate a variety of beverage can dimensions. For example, the standard beverage can in the United States is 122.3 mm tall, and a standard seal 140 may be provided to accommodate that beverage can. But in Europe, the standard beverage can is 116.42 mm tall, so a thicker seal 140 may be provided to make up the difference in height between the US can and the European can. Other territories may also have different size beverage cans, and other seal sizes may be used to accommodate those beverage cans.

The depth of the inner shell 110 is sized so that when a beverage can is placed in the inner shell 110 and the lid component is locked onto the mug component using the tab 212 of the lid component 200 and the L-shaped recess 132 of the mug component 100, the sealed joint 141 is formed. The mug and lid assembly can then be used as described above, and the sealed joint 141 prevents a beverage from the beverage can from spilling into the void 144.

The lower end 108 of the outer shell 102 is adapted to connect with an upper end 302 of a beverage holder support 300. The beverage holder support 300 may connect to a variety of beverage holders, such as a mug component, a cup, or a beverage holder such as a soft sleeve or the like that receives a beverage container such as a beverage can. Various means and methods of connecting the beverage holder support to the mug component 100 may be used. The connecting method shown in FIG. 6 includes a device connector 148 located on the lower end 108 of the outer shell 102 that connects to a holder connector 304 located on the upper end 302 of the beverage holder support 300. Here, a magnet 150 is included in the device connector 148 and a ferrous component 306 is included in the holder connector 304 for connecting the mug component 100 to the beverage holder support 300.

When magnets are used, typically they are permanent magnets. And typically, magnets that retain a substantial amount of their magnetism over a period of time, such as five years, are used. Also, the magnets may be installed in different configurations. For example, the magnet may be included in the beverage holder support and the ferrous component may be included in the mug component. Additionally, a magnet may be included in the beverage holder support and another magnet may be included in the mug component. When two magnets are used, the magnets are orientated in their respective components so that the opposite poles face each other and attract one another.

Figure 8:
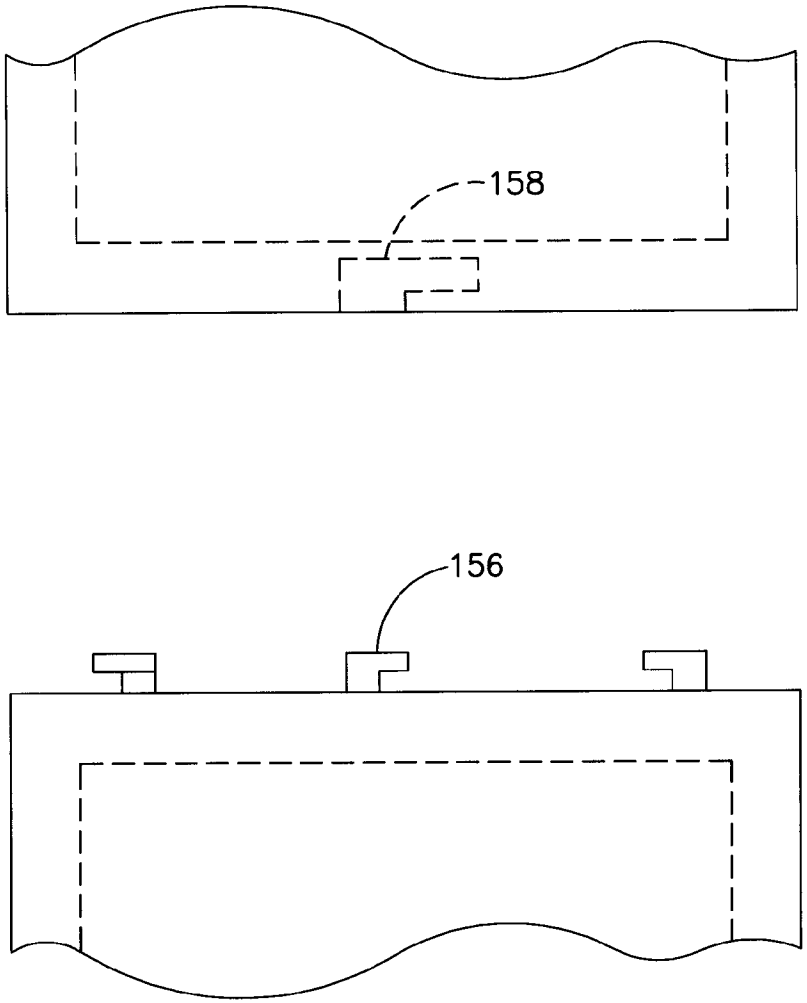
FIG. 8 is a section view of a beverage holder support locking mechanism of the invention.

Other methods may also be used to connect the mug component to the beverage holder support. For instance, a twist lock mechanism as shown in FIG. 8 may also be used. The twist lock mechanism has a plurality of L-shaped locking tabs 156 upwardly projecting from the upper end of the beverage holder support that engage with a plurality of corresponding of locking tab receiving slots 158 located on the lower end 108 of the outer shell 102 of the mug component 100. Additionally, a hook and loop connector, such as Velcro™, may be used as the means for connecting the beverage holder support 300 to the beverage holder. The beverage holder may have the hook portion of the hook and loop connector, and the beverage holder support may have the loop portion of the hook and loop connector. Alternatively, the beverage holder may have the loop portion of the hook and loop connector, and the beverage holder support may have the hook portion of the hook and loop connector.

The beverage holder support may be adapted to fit other support surfaces, such as a dashboard, a handlebar on a bike or motorcycle, a tractor ROPS, or any other surface capable of receiving a beverage holder support. The beverage holder support may be used to hold a recreational accessory such as a squirt gun, umbrella, or action figure. When a recreational accessory is used, a lower end of the recreational accessory is adapted in a manner similar to the lower end of a beverage holder, thereby having a recreational accessory connector that is received by the beverage holder receiver. The various methods described above for connecting a beverage holder to a beverage holder support, such as magnets, twist lock, Velcro, and an elastic cord may also be used to connect a recreational accessory to a beverage holder support.

Figure 7:
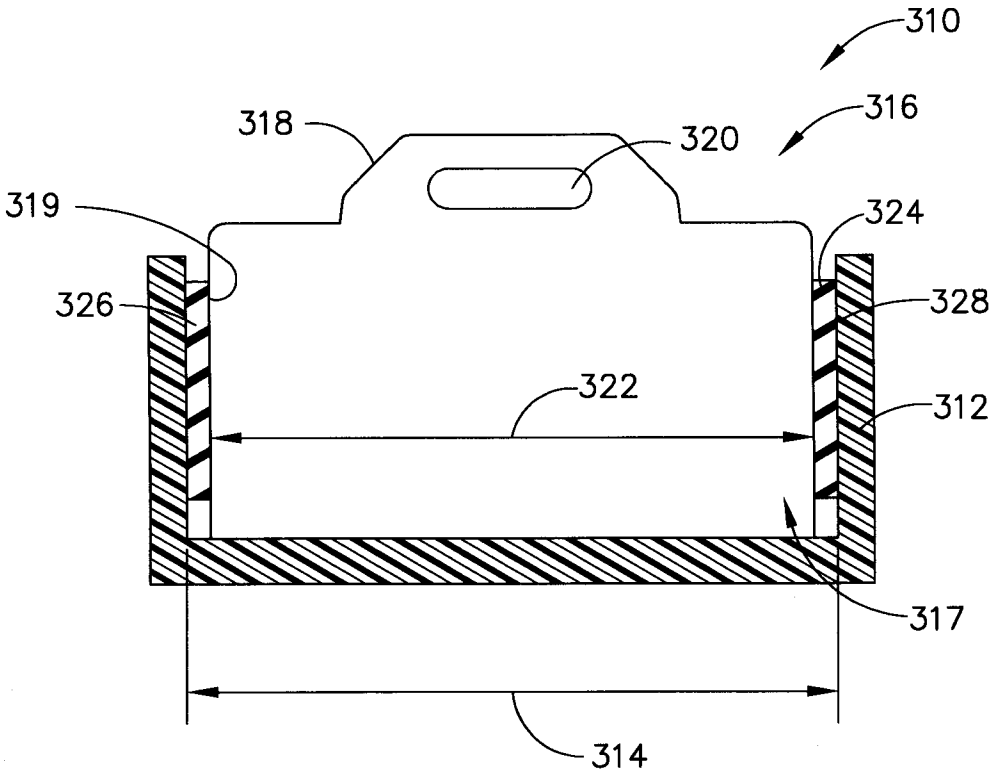
FIG. 7 is a section view of another embodiment of a beverage holder support of the invention.

FIG. 7 shows another embodiment of a beverage holder support, a beverage holder support 310 for a cup holder 312. The beverage holder support 310 has an upper end 316, a lower end 317, and a sidewall 319 disposed therebetween and is adapted to fit into a cup holder 312. The cup holder 312 is typical of those found in a car, truck, or other vehicle. The beverage holder support 310 may be used to adapt a cup holder 312, whose inside diameter 314 is too small to receive the mug component 100, to hold the mug component 100. The upper end 316 of the beverage holder support 310 includes a connector 318 extending from the upper end 316 with a ferrous component 320, as described earlier. Other methods of connecting the beverage holder support 310 to a mug component may also be used, as described herein.

The beverage holder support 310 has an outside diameter 322 that is less than the inside diameter 314 of the cup holder 312. Expanding sections 324 and 326 may be used to lock the beverage holder support 310 to the cup holder. The expanding sections protrude away from the beverage holder support 310 and bias against an inside portion 328 of the cup holder 312 to lock the beverage holder support 310 into place. By locking the beverage holder support into place, the beverage holder support will remain in the cup hold when the mug component 100 is removed from the beverage holder support 310. One, two, three, or more expanding sections may be used.

Figure 9:
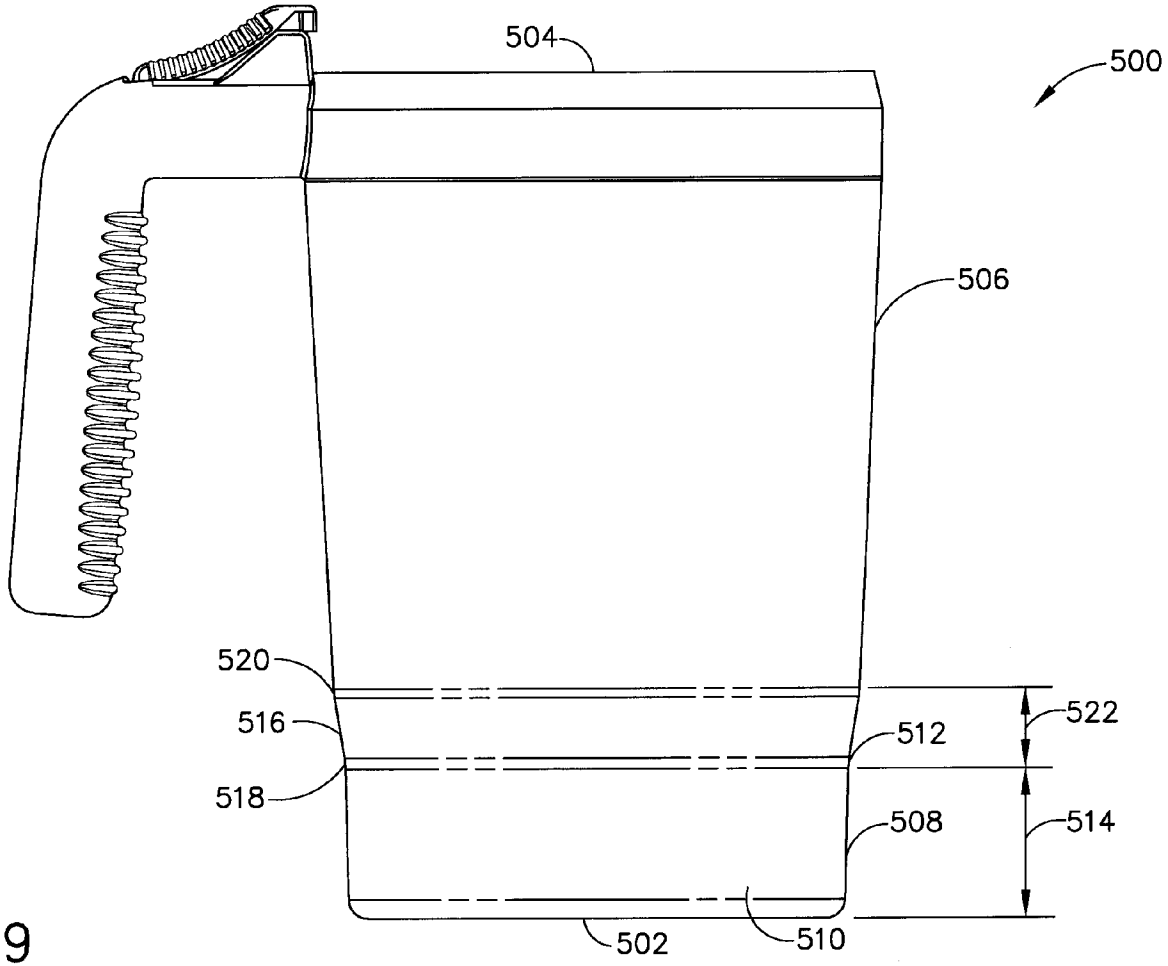
FIG. 9 is a side view of another embodiment of a mug component of the invention.

FIG. 9 shows another embodiment of a mug component, an adapted mug component 500 constructed to fit in a cup holder located in a car or on a boat. The adapted mug component 500 has a bottom 502, a top 504, and a sidewall 506 disposed therebetween. A lower circumferential portion 508 has a lower end 510 and an upper end 512. The distance 514 between the lower end 510 and the upper end 512 is preferably between 0.75 inches and 1.25 inches, more preferably between 0.875 inches and 1.125 inches, more preferably between 0.9375 inches and 1.0625 inches, and most preferably about 0.965 inches. The circumferential portion 508 has a diameter preferably between 3 inches and 3.5 inches, more preferably between 3.1 inches and 3.4 inches, more preferably between 3.2 inches and 3.3 inches, and most preferably about 3.265 inches at its lower end 510. The circumferential portion 508 has a diameter preferably between 3 inches and 3.5 inches, more preferably between 3.1 inches and 3.4 inches, more preferably between 3.2 inches and 3.3 inches, and most preferably about 3.298 inches at its upper end 512.

A tapered circumferential portion 516 has an upper end 520 and a lower end 518 that mates with the upper end 512 of the lower circumferential portion 508. The distance 522 between the lower end 518 and the upper end 520 is preferably between 0.2 inches and 0.8 inches, more preferably between 0.3 inches and 0.7 inches, more preferably between 0.4 inches and 0.6 inches, and most preferably about 0.513 inches. The tapered circumferential portion 516 has a diameter preferably between 3.2 inches and 3.8 inches, more preferably between 3.3 inches and 3.7 inches, more preferably between 3.4 inches and 3.6 inches, and most preferably about 3.453 inches at its upper end 520. The tapered circumferential portion 516 has a diameter preferably between 3 inches and 3.5 inches, more preferably between 3.1 inches and 3.4 inches, more preferably between 3.2 inches and 3.3 inches, and most preferably about 3.265 inches at its lower end 510.

Figure 10:
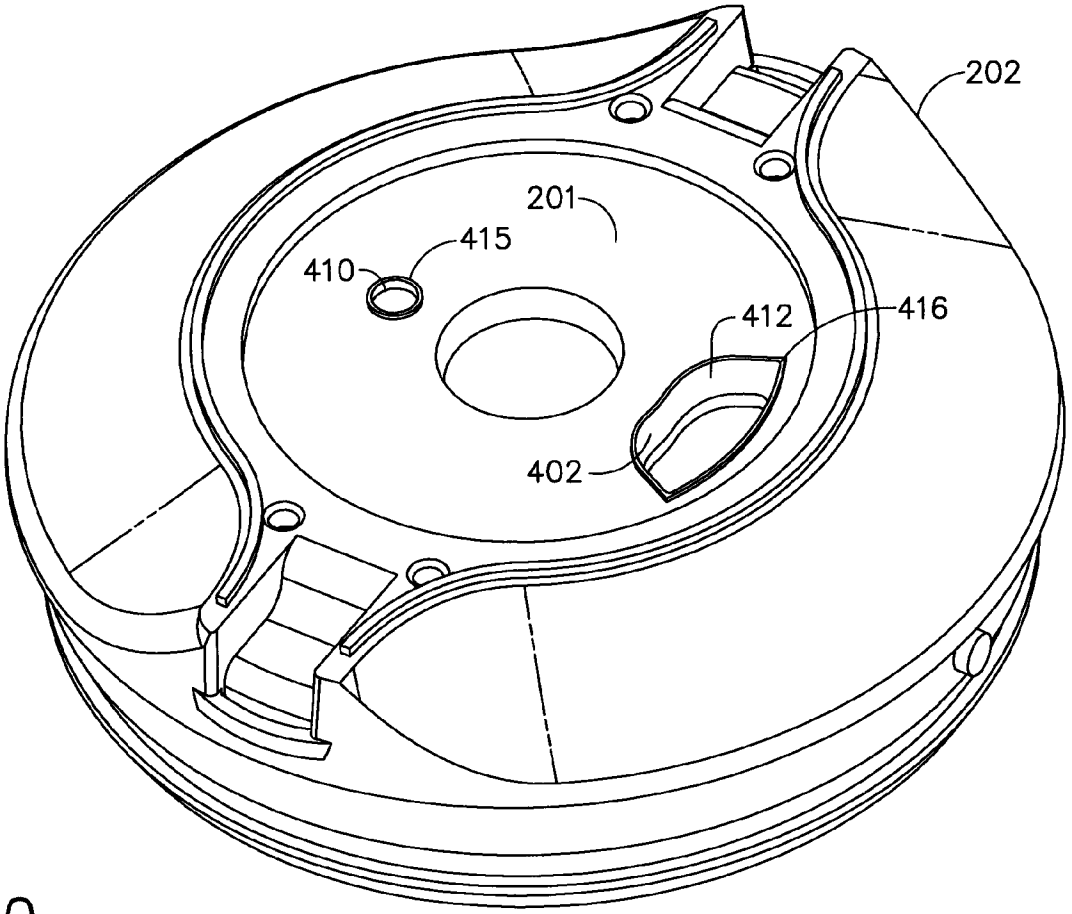
FIG. 10 is a perspective view of the top of a lid body of the invention with a rotatable sealing plate seal installed.
Figure 11:
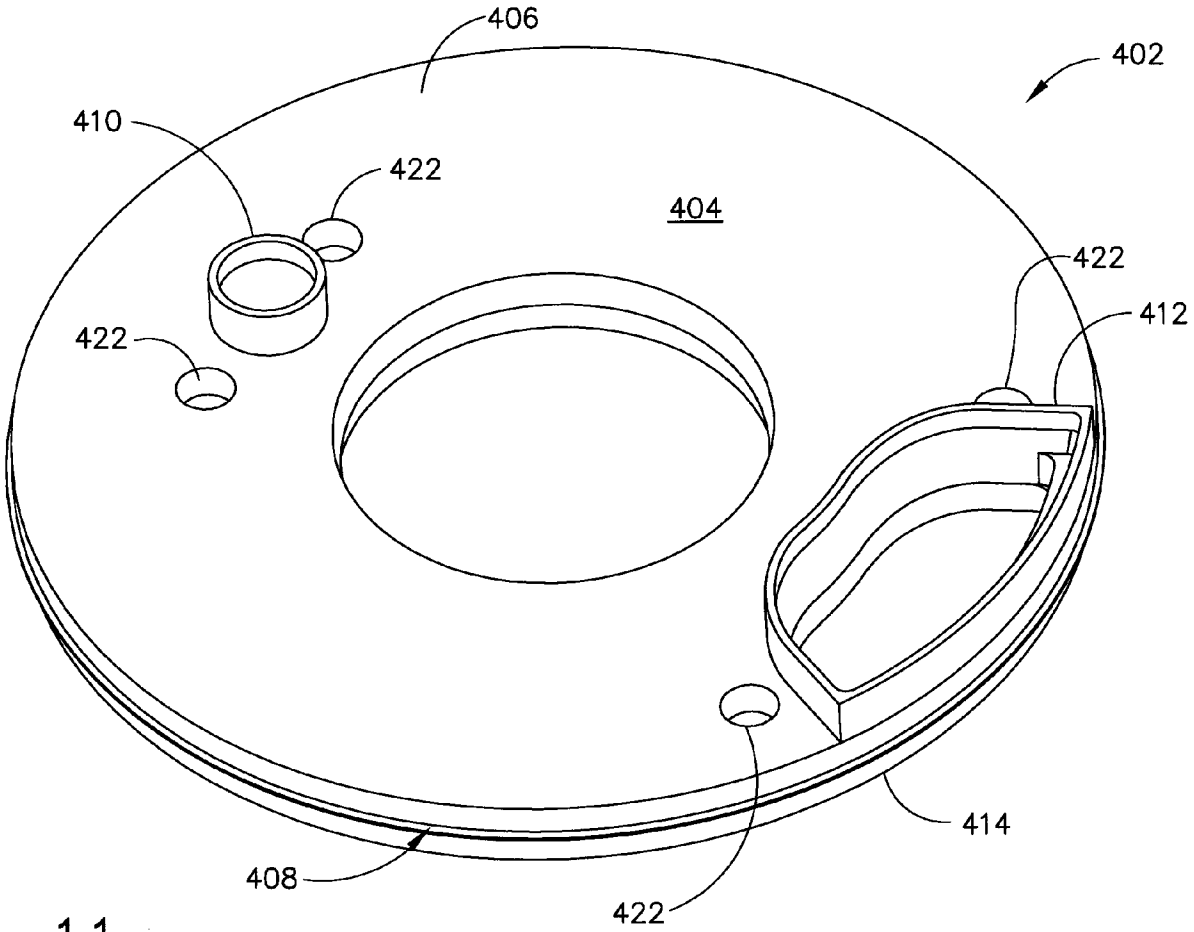
FIG. 11 is a perspective view of a rotatable sealing plate seal of the invention.

FIG. 10 show an embodiment of the lid body 202 with a rotatable sealing plate seal 402. As shown in FIG. 11, the rotatable sealing plate seal 402 has a donut shaped base 404 with an upper face 406 and a lower face 408. The seal is typically made from a flexible sealing material, such as a rubber, but other types of soft compounds may also be used. The upper face 406 has a vent hole portion 410 protruding upwardly from the upper face 406 and a beverage dispensing aperture portion 412 protruding upwardly from the upper face 406. The vent hole portion 410 and the beverage dispensing aperture portion 412 typically protrude upwardly from the upper face a distance that is greater than a thickness 145 (FIG. 6) of the lid body 202. A retaining plate 414, typically made from a material such as plastic that is harder than the rubber seal, provides rigidity and support to the rotatable sealing plate seal 402.

As shown in FIG. 10, an upper area 415 of the vent hole portion 410 protrudes above an upper face 201 of the lid body 202 and an upper area 416 of the beverage dispensing aperture portion 412 protrudes above the upper face 201 of the lid body 202. With the rotatable sealing plate 230 installed against the upper face 201 of the lid body 202 and in the closed position, as shown in FIG. 5B, the upper area 415 and the upper area 416 of the rotatable sealing plate seal 402 are compressed against the rotatable sealing plate 230. A seal is thereby created between the rotatable sealing plate seal 402 and the rotatable sealing plate 230, preventing a beverage contained in the mug from leaking between the rotatable sealing plate 230 and the upper face 201 of the lid body 202 if the mug is tipped over.

Figure 12:
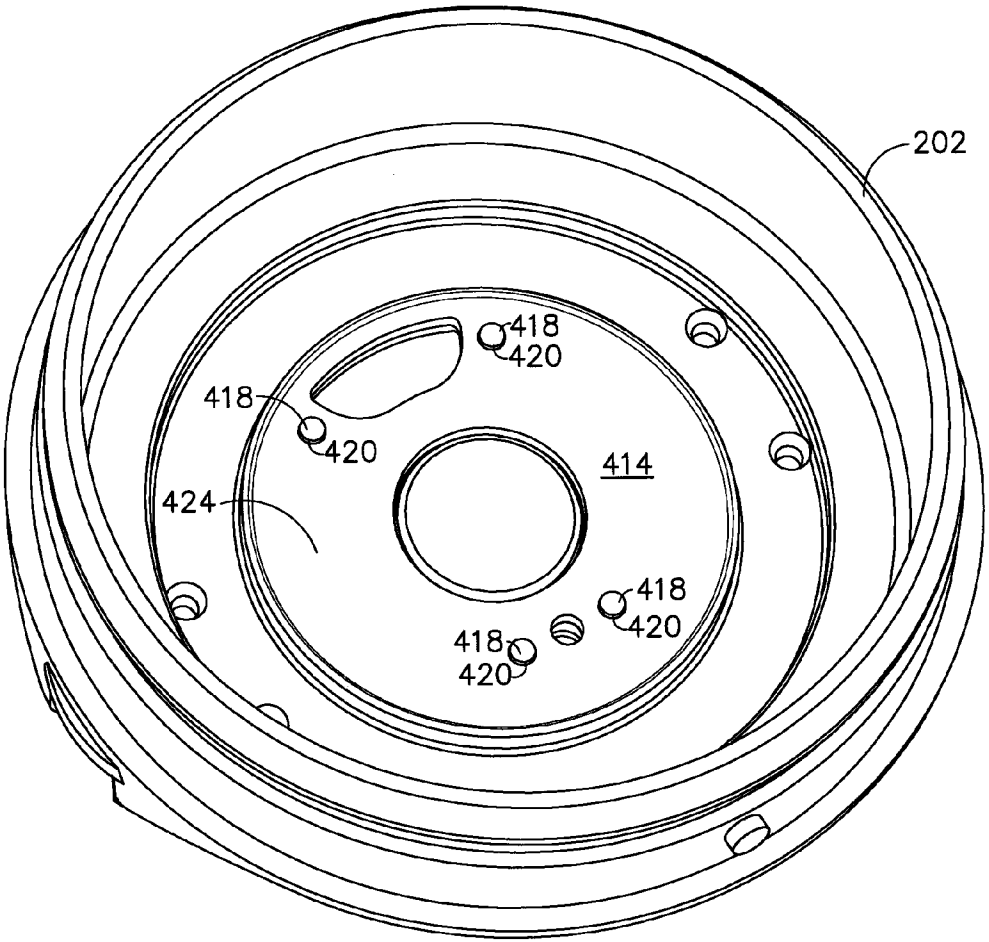
FIG. 12 is a perspective view of the bottom of the lid body of FIG. 10 with a rotatable sealing plate seal and retaining plate of the invention.

FIG. 12 shows one method of attaching the rotatable sealing plate seal 402 and the retaining plate 414 to the lid body 202. The lid body has four pegs 418 that pass through four corresponding holes 420 in the retaining plate 414 and four corresponding holes 422 in the seal 402 (FIG. 11). More or less pegs and corresponding holes may be used. The seal 402 is disposed between the lid body 202 and the retaining plate 414 and the pegs 418 pass through the holes 420 and 422 in the retaining plate 414 and the seal 402 and protrude beyond a lower face 424 of the retaining plate. The pegs 418, which are typically made of the same plastic as the lid body 202, are then heated and mashed over to secure the retaining plate 414 and the seal 402 to the lid body 202.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. The invention is therefore not limited to the specific details, representative apparatus and method, and illustrated examples shown and described. Accordingly, departures may be made from such details without departing from the scope or spirit of the invention.

What is claimed is:

1. A beverage lid comprising:

a. a lid body having an aperture for dispensing a beverage, b. a lid cap having an aperture for dispensing a beverage mounted to the lid body, c. a slideable arm having a first end and a second end opposite the first end, the slideable arm mounted between the lid body and the lid cap, d. a rotatable plate having at least one aperture for dispensing a beverage mounted between the body and the lid cap, e. a rotatable plate actuating mechanism communicating the slideable arm with the rotatable plate, and f. wherein the rotatable plate actuating mechanism comprises a rack disposed on the slideable arm and a gear disposed on the rotatable plate and meshing with the rack.

2. The beverage lid according to claim 1, further comprising a slideable actuator abutting with the first end or the second end of the slideable arm for actuating the slideable arm.

3. A beverage lid comprising:

a. a lid body having an inner circumference and an aperture for dispensing a beverage, b. a lid cap having an aperture for dispensing a beverage mounted to the lid body, c. a slideable arm having a first end and a second end opposite the first end, the slideable arm mounted between the lid body and the lid cap, d. a rotatable plate having at least one aperture for dispensing a beverage mounted between the body and the lid cap, e. a rotatable plate actuating mechanism communicating the slideable arm with the rotatable plate, f. a slideable actuator abutting with the first end or the second end of the slideable arm for actuating the slideable arm, and g. wherein the slideable arm further comprises a spring having a distal end, wherein the distal end of the spring is biased against the inner circumference of the lid cap for returning the slideable arm to a center position when the slideable actuator is released.

4. The beverage lid according to claim 1, further comprising:

a. a beverage holder support having an upper end, a lower end, and a sidewall disposed therebetween adapted to fit in a cup holder, b. a holder connector disposed on the upper end of the holder, c. a mug having an upper end, a lower end, wherein the lid body is disposed on the upper end of the mug, and d. a device connector disposed on the lower end of the mug, wherein the holder connector is sized to receive the device connector.

5. The beverage lid according to claim 4, wherein the device connector includes a magnet and the holder connector includes a ferrous component.

6. The beverage lid according to claim 4, wherein the device connector includes a ferrous component and the holder connector includes a magnet.

7. The beverage lid according to claim 4, wherein the holder connector includes a magnet and the device connector includes a magnet.

8. The beverage lid according to claim 4, wherein the holder connector is a plurality of upwardly projecting locking tabs and the device connector is a corresponding plurality of locking tab receiving slots.

9. The beverage lid according to claim 4, wherein the holder connector is a loop portion of a hook and loop connector and the device connector is a hook portion of a hook and loop connector.

10. The beverage lid according to claim 4, wherein the holder connector is a hook portion of a hook and loop connector and the device connector is a loop portion of a hook and loop connector.

11. An apparatus comprising:

a. beverage holder support having an upper end, a lower end, and a sidewall disposed therebetween adapted to fit in a cup holder, b. a holder connector disposed on the upper end of the holder, c. a mug having an upper end, a lower end, wherein the lid body is disposed on the upper end of the mug, d. a device connector disposed on the lower end of the mug, wherein the holder connector is sized to receive the device connector, and wherein the mug comprises a lid body having an aperture for dispensing a beverage, a lid cap having an aperture for dispensing a beverage and mounted to the lid body, a slideable arm having a first end and a second end opposite the first end, the slideable arm mounted between the lid body and the lid cap, a rotatable plate having at least one aperture for dispensing a beverage mounted between the body and the lid cap, and the rotatable plate actuating mechanism communicating the slideable arm with the rotatable plate, and e. further comprising a slideable actuator abutting with the first end or the second end of the slideable arm for actuating the slideable arm.

12. The apparatus according to claim 11, wherein the lid cap has an inner circumference and is installed on the lid body, wherein the slideable arm further comprises a spring having a distal end, wherein the distal end of the spring is biased against the inner circumference of the lid cap for returning the slideable arm to a center position when the slideable actuator is released.

13. The apparatus according to claim 11, wherein the device connector includes a magnet and the holder connector includes a ferrous component.

14. The apparatus according to claim 11, wherein the device connector includes a ferrous component and the holder connector includes a magnet.

15. The apparatus according to claim 11, wherein the holder connector includes a magnet and the device connector includes a magnet.

16. The apparatus according to claim 11, wherein the holder connector is a plurality of upwardly projecting locking tabs and the device connector is a corresponding plurality of locking tab receiving slots.

17. The apparatus according to claim 11, wherein the holder connector is a loop portion of a hook and loop connector and the device connector is a hook portion of a hook and loop connector.

18. The apparatus according to claim 11, wherein the holder connector is a hook portion of a hook and loop connector and the device connector is a loop portion of a hook and loop connector.

* * * * *